US007406783B2

(12) United States Patent
Alipour

(10) Patent No.: US 7,406,783 B2
(45) Date of Patent: Aug. 5, 2008

(54) SELF LIFTING IRON

(76) Inventor: Ehsan Alipour, 100 Almendar Dr., Greenbrea, CA (US) 94904

( * ) Notice: Subject to any disclaimer, the term of this patent is extended or adjusted under 35 U.S.C. 154(b) by 0 days.

(21) Appl. No.: 11/137,921

(22) Filed: May 25, 2005

(65) Prior Publication Data

US 2005/0210719 A1 Sep. 29, 2005

Related U.S. Application Data

(63) Continuation of application No. 10/253,181, filed on Sep. 23, 2002, now Pat. No. 6,925,738, which is a continuation of application No. 09/861,166, filed on May 18, 2001, now Pat. No. 6,453,587.

(51) Int. Cl.
*D06F 75/40* (2006.01)
*D06F 75/18* (2006.01)

(52) U.S. Cl. ..... 38/79

(58) Field of Classification Search ..... 38/79, 38/94, 96, 97, 77.7; 219/245, 248, 259, 257, 219/250

See application file for complete search history.

(56) References Cited

U.S. PATENT DOCUMENTS 2,076,614 A * 4/1937 Bowman ..... 38/74
2,149,251 A * 3/1939 Campana ..... 38/79
2,211,839 A * 8/1940 Simonsen ..... 38/79
2,224,896 A * 12/1940 Burian ..... 38/79
2,470,532 A * 5/1949 Thomas ..... 219/257
2,596,314 A * 5/1952 Wales ..... 38/79
2,602,247 A * 7/1952 Cochran ..... 38/79
3,200,521 A * 8/1965 Whitfield ..... 38/79
5,042,179 A * 8/1991 van der Meer ..... 38/77.83
5,380,983 A * 1/1995 Cavada et al. ..... 219/250
5,721,418 A * 2/1998 Hazan et al. ..... 219/257
5,852,279 A * 12/1998 Mak et al. ..... 219/257
5,917,165 A * 6/1999 Platt et al. ..... 200/600
5,966,851 A * 10/1999 Serpa ..... 38/79
6,079,133 A * 6/2000 Netten ..... 38/77.7
6,260,295 B1 * 7/2001 Nickel ..... 38/79
6,307,182 B1 * 10/2001 Lile ..... 219/257
6,384,379 B1 * 5/2002 Reime ..... 219/257
6,438,876 B2 * 8/2002 Har et al. ..... 38/77.7
6,453,587 B1 * 9/2002 Alipour ..... 38/79
6,715,222 B2 * 4/2004 Hecht ..... 38/79
6,925,738 B2 * 8/2005 Alipour ..... 38/79

FOREIGN PATENT DOCUMENTS

JP 407185198 A * 7/1995

* cited by examiner

*Primary Examiner*—Ismael Izaguirre
(74) *Attorney, Agent, or Firm*—GSS Law Group; Gregory Scott Smith

(57) ABSTRACT

The present invention is a clothing iron capable of lifting the iron, and thus the hot sole plate of the iron, away from a surface on which the iron rests when the iron is not in use, to reduce or prevent damage to the surface on which the iron rests. An important characteristic of the invention is that the sole plate of the iron is lifted in a direction including a vertical vector, with a plane of the sole plate remaining roughly horizontal. The elevation of the iron is accomplished through the use of an elevation mechanism including apparatus for extending at least one leg from the underside of the iron when the sensor indicates that the user's hand is not in contact with the iron.

13 Claims, 7 Drawing Sheets

SELF LIFTING IRON

CROSS REFERENCE TO RELATED APPLICATIONS

This application is a continuation application of utility patent application Ser. No. 10/253,181 filed Sep. 23, 2002 now U.S. Pat. No. 6,925,738, which is a continuation of utility patent application Ser. No. 09/861,166 filed May 18, 2001 now U.S. Pat. No. 6,453,587.

FIELD OF INVENTION

The present invention relates to electric appliances, and more specifically, to an electric iron adopted to preventing the burning of fabric or ironing board surfaces when the iron is disengaged by the operator or inadvertently left unattended.

DESCRIPTION OF RELATED ART

An electric clothes iron consists essentially of a heated sole plate that is pressed against fabric to remove wrinkles. To be effective, the sole plate of an iron must be very hot. Thus, there is a serious danger of burning the fabric or ironing board or even igniting a fire from an electric iron inadvertently left unattended. In addition, lifting and placing an iron on its tail can be physically straining on the operator's wrist, especially those who suffer from arthritis. Furthermore, when the iron is placed on its tail, the hot sole plate is exposed and may cause accidental contact with the sole plate by the user can result in severe burns.

Some pre-existing flat irons have utilized tilting mechanisms, typically hinging near the base of the tail, to raise the sole plate away from the ironing board when left unattended. However, these types of flat irons are frequently unstable and exposed the hot sole plate. Furthermore, these irons generally do not provide enough separation between the sole plate and the ironing board at the tail section. Modern electric irons have base plates to allow the user to stand the iron in a vertical position away from the fabric, but the hot sole plate is still exposed to accidental contact by the user or others. Furthermore, the small base plate and vertical orientation of the standing iron makes such irons prone to falling over due to a high center of mass, which may cause the hot sole plate to inadvertently contact and damage nearby fabric or ironing board surfaces or burn hands.

To reduce the danger of burning the fabric or ironing board by an unattended iron, most electric irons have automatic shut-off devices. The automatic shut-off devices turn off power to the sole plate heater when the iron has not been used for a fixed period of time, such as 10 minutes. Although a 10-minute shut-off cycle is appropriate for avoiding long-term operation of an electric iron in the absence of use, damage may occur long before the expiration of the 10-minute timing cycle, if the sole plate of an electric iron remains stationary in contact with fabric or other surfaces susceptible to marking, charring, or other heat damage. However, reducing the timing cycle to a short enough value to avoid such damage interferes with the normal usage of the electric iron.

Various schemes have been devised to determine when the iron is in use and what timing cycle should be used. For example, some irons use motion sensors or accelerometers. When the iron is moved by the user, the motion sensor repeatedly resets the automatic shut off timer so that power will not be removed from the sole plate when the user is operating the iron. One disadvantage of this type of iron is that it automatically shuts off when held motionless by the user. Also, such an iron may not function properly on an uneven surface.

What is needed is an electric iron that avoids the disadvantages of pre-existing electric irons discussed above, that automatically raises the hot sole plate away from the fabric or the ironing board surface to prevent burning of the fabric or the ironing board surface if the iron is disengaged by the operator or inadvertently left unattended, that automatically raises the sole plate upon removal of the user's hand or during a power outage, that prevents the burning of fabric by creating an even vertical separation between the sole plate and fabric immediately after disengagement by the operator, and that reduces the possibility of being tipped over and exposing the hot sole plate.

SUMMARY OF INVENTION

Accordingly, the present invention is a clothing iron capable of lifting the sole plate of the iron away from a surface on which the iron rests when the iron is not in use. An important characteristic of the invention is that the sole plate of the iron is lifted in a direction including a substantial vertical vector, preferably with a plane of the sole plate remaining roughly horizontal. The lifting is accomplished with the use of at least one leg that extends downward from the iron to lift the sole plate.

In general, the invention comprises an actuation device, a sole plate including a top surface and a bottom surface, a housing coupled to the top surface of the sole plate, at least one leg for lifting the sole plate, and an elevation mechanism positioned within the housing capable of moving the leg to allow the sole plate of the iron to contact the horizontal surface under the sole plate. Any number, shape, and size of legs may be used, although two legs are used in some preferred embodiments. The legs may extend from beside the sole plate of the iron, or through apertures in the sole plate of the iron, or any combination thereof. In some embodiments the legs may be extended and withdrawn in a motion along a vertical axis, or in other embodiments, the legs may be rotated up and down as desired. When retracted, the legs are preferably withdrawn into the housing of the iron. In other embodiments, the leg may retract into a perforated surface that extends from the sole plate. Preferred characteristics of the selected leg configuration include resistance to tipping, and the provision of sufficient space between the support surface and the underside of the iron. The extended legs also act as a sole plate guard, in the event the iron is tilted on its side the legs may prevent accidental contact with the exposed sole plate. A sensor is preferably located in the handle of the iron capable of perceiving when a user has gripped the handle of the iron. Virtually any known and acceptable sensors may be used. In alternate embodiments, additional sensors may be used, and the sensors may be positioned in places other than the handle.

In one preferred embodiment, the elevation mechanism comprises a lift plate with a top side and a bottom side. The legs are coupled to the bottom side of the lift plate. The lift plate is preferably capable of moving up and down along a path or vector including a substantial vertical element. The lift plate is preferably biased downward so that the legs are normally extended. Thus, when the power to the iron is off, or when the user is not in contact with the handle of the iron, the legs are extended. In a preferred embodiment, the downward bias is provided by one or more springs in contact with the lift plate. A means for overcoming the downward bias of the lift plate is coupled to the lift plate so that when the sensor perceives that the user has grasped the handle of the iron, the elevation mechanism is activated and the legs are pulled up into the housing. This allows the sole plate may contact the support surface. In a preferred embodiment, the means for overcoming the downward bias is at least one geared stepper motor that, when supplied with power, will generate a larger force than that of the biased springs causing the lift plate to bias upwards. When the power to the geared stepper motor is disconnected, the spring force preferably will cause the lift plate to bias downward.

In a preferred embodiment, the tail comprises a slight rounded edge. This tail configuration is preferably capable of allowing the sole plate to slide over buttons or uneven sections of fabric. Virtually any shape of the tail that allows smooth transition of the sole plate over uneven surfaces may be used.

BRIEF DESCRIPTION OF THE DRAWINGS

A preferred embodiment of the present invention is further described in connection with the accompanying drawings, in which.

DETAILED DESCRIPTION OF THE INVENTION

The following description is provided to enable any person skilled in the art to make and use the invention and sets forth the best mode presently contemplated by the inventor of carrying out his invention. Various modifications, however, will remain readily apparent to those skilled in the art, as generic principles of the present invention have defined herein.

The present invention is a clothing iron capable of lifting the iron, and thus the hot sole plate of the iron, away from a surface on which the iron rests when the iron is not in use, to reduce or prevent damage to the surface on which the iron rests. Typically the surface on which the iron rests is an ironing board with an article of clothing or the like laying thereon. An important characteristic of the invention is that the entire sole plate of the iron is lifted in a direction including a vertical vector. In a preferred embodiment, the plane of the sole plate remains roughly horizontal. The elevation of the iron is accomplished through the use of an elevation mechanism including apparatus for extending at least one leg from the underside of the iron, to lift the iron.

The present invention may be used with virtually any practical or desired iron configuration, and the configuration of the iron and of any particular features of the iron not related directly to the mechanisms of the invention are not critical to the invention. In addition to the heated sole plate which is used to remove wrinkles from fabric, modern electric irons typically include a housing with a handle on the top of the housing, heating elements to heat the sole plate, a heat barrier between the sole plate and the housing or body of the iron, and a cord to plug into an electric wall socket. Conventional iron controls typically include on/off switches, steaming and heating controls, and automatic shut-off mechanisms. Such features are assumed to be included on the embodiment of the iron disclosed herein, but are not shown in the figures.

Figure 1:
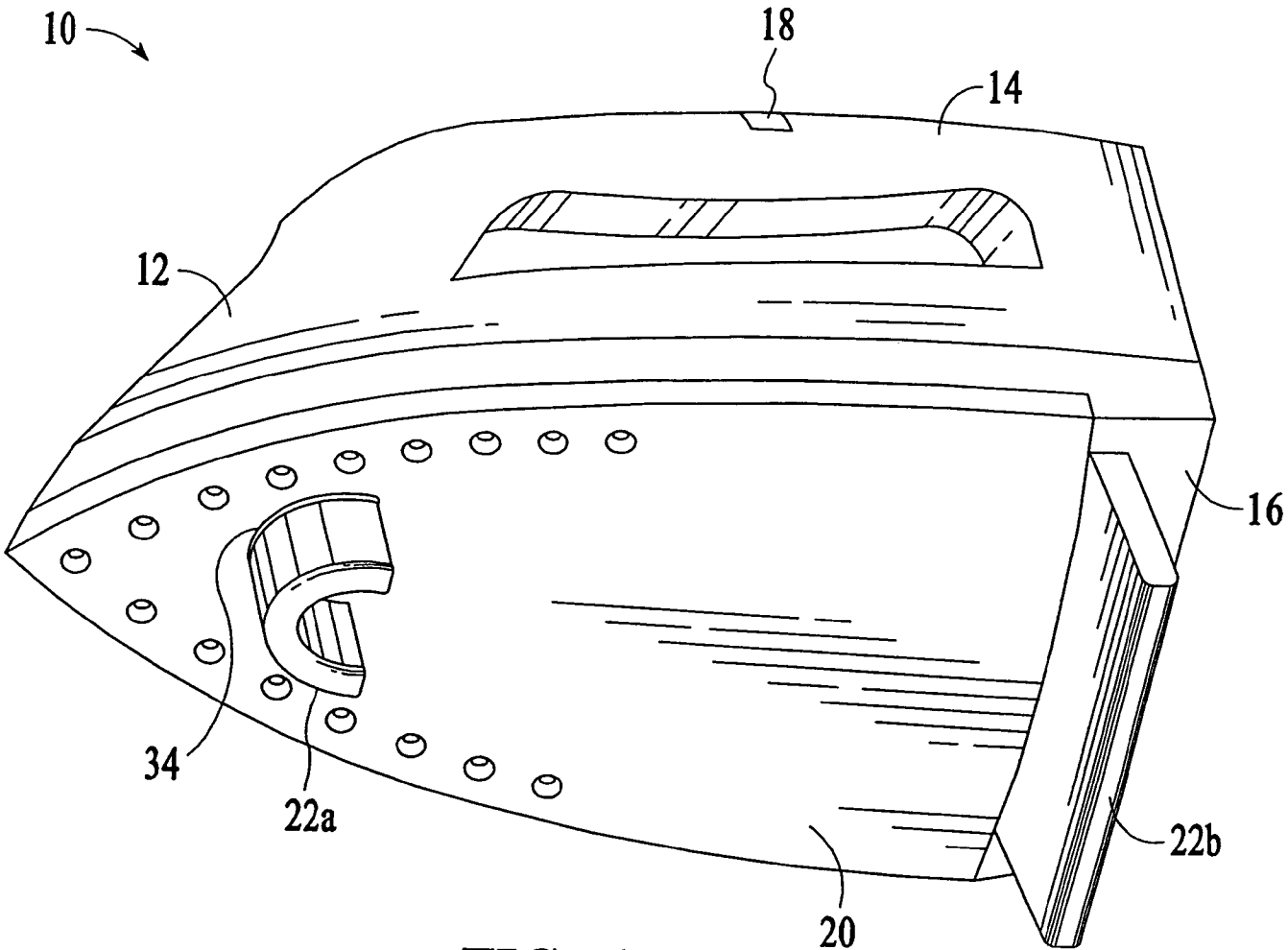
FIG. 1 is a perspective bottom view of a preferred embodiment of electric iron of the invention with the legs extended.
Figure 2:
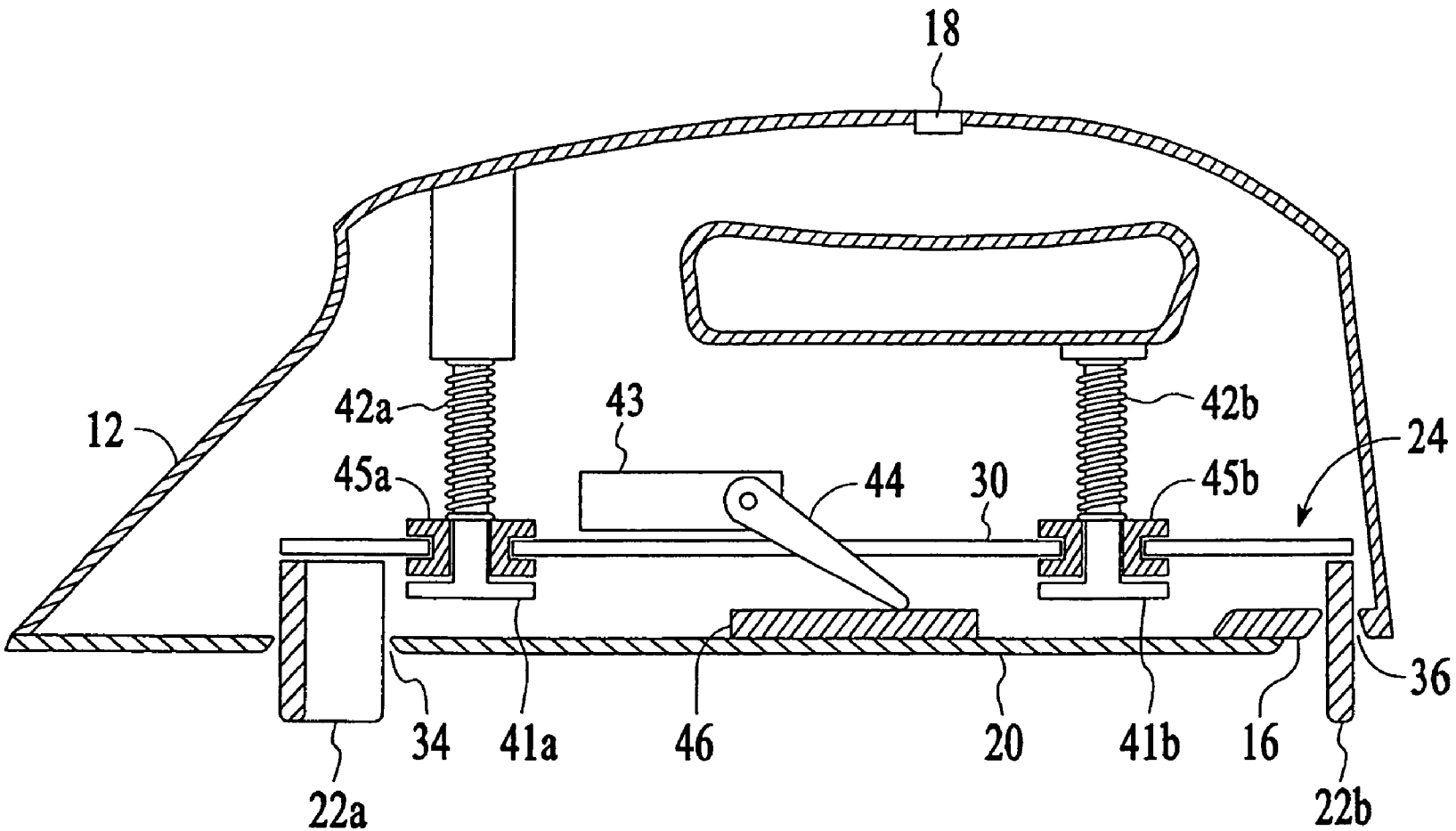
FIG. 2 is a perspective view partly in section showing a preferred embodiment of the elevating mechanism of the invention with the legs extended.

Referring now to the Figures, FIG. 1 is a bottom perspective view of an embodiment of the invention showing an iron 10 including a housing 12 with a handle 14 on the top of the housing 10, a heat barrier 16, an actuation device 18 in the handle 14, a sole plate 20 on the underside of the housing 12, and a pair of legs 22*a* and 22*b* extending from the bottom of the iron 10. FIG. 2 is a side view of the iron 10 on an ironing board 26, with the iron 10 in its neutral state with legs 22*a* and 22*b* extended. The bottom of the sole plate 20 has been lifted from the top surface of the ironing board 26.

FIGS. 3A and 3B show a partial cutaway side view of the iron 10 of FIG. 1 in which one embodiment of the elevation mechanism 24 is visible. The function of the elevation mechanism 24 is to preferably relatively uniformly elevate the sole plate 20 away from the fabric or ironing board 26 surface in a direction including a vertical vector while preferably maintaining the roughly horizontal plane of sole plate 20, and to provide a stable base when the iron 10 is elevated. In prototype testing it was determined that an approximately lift distance preferably ranging from 0.5 inch to 1.5 inches, and more preferably approximately 1 inch, between the bottom of the sole plate 20 and the fabric or ironing board surface 26 was sufficient to prevent heat damage to fabric on the ironing board surface 26. In alternate embodiments, other vertical distances may be selected. In further alternate embodiments, the sole plate need not be maintained in a substantially horizontal position, in which case it is preferabe that the portion of the sole plate closest to the support surface be lifted at least a distance preferably ranging from 0.5 inch to 1.5 inches, and more preferably approximately 1 inch.

A large number of kinds and variations of the elevation mechanisms may be used in the invention, and such variations may be readily apparent to one skilled in the art. Therefore, the preferred embodiments disclosed herein should be considered as example mechanisms for accomplishing the elevation of the iron.

The elevation mechanism 24, generally seen in FIGS. 1 through 4, preferably includes an actuation device 18 to activate the elevation means 24, at least one leg to lift the iron, a means for biasing the legs into an extended position, and a means for overcoming the bias causing the legs to extend.

Preferably, the actuation device 18 comprises a sensor capable of detecting the grip of a user on the handle 14 of the iron 10. The actuation device 18 can be any commercially available device capable of switching electrical or mechanical states and can be situated in various locations on the iron 10, although preferably in the handle 14 of the iron 10. In prototype construction, the actuation device 18 used was a photosensor switch located in the handle, as seen in FIGS. 1 through 4. However, many other kinds of actuation devices may be acceptable, such as heat sensors, conductivity switches or pressure activated switches, force sensors, capacitive sensors, matched emitter detector pairs, or light or signal emitters and receivers that are interrupted when the iron is grabbed.

The actuation device 18 is preferably configured in a normally open state. In the embodiment shown, the actuation device 18 is a photosensor that closes, or completes a circuit activating the elevation mechanism 24 when a hand is placed over the photosensor of the actuation device 18 reducing the amount of light perceived by the photosensor to below a selected threshold. When the elevation mechanism 24 is activated, the legs 22*a* and 22*b* are caused to retract, allowing the sole plate 20 to contact the ironing board 26. Upon releasing the handle 14, the actuation device 18 opens, breaking the electrical connection and allowing the biased force to extend the legs 22*a* and 22*b* raising the iron 10 away from the ironing board 26.

Figure 4:
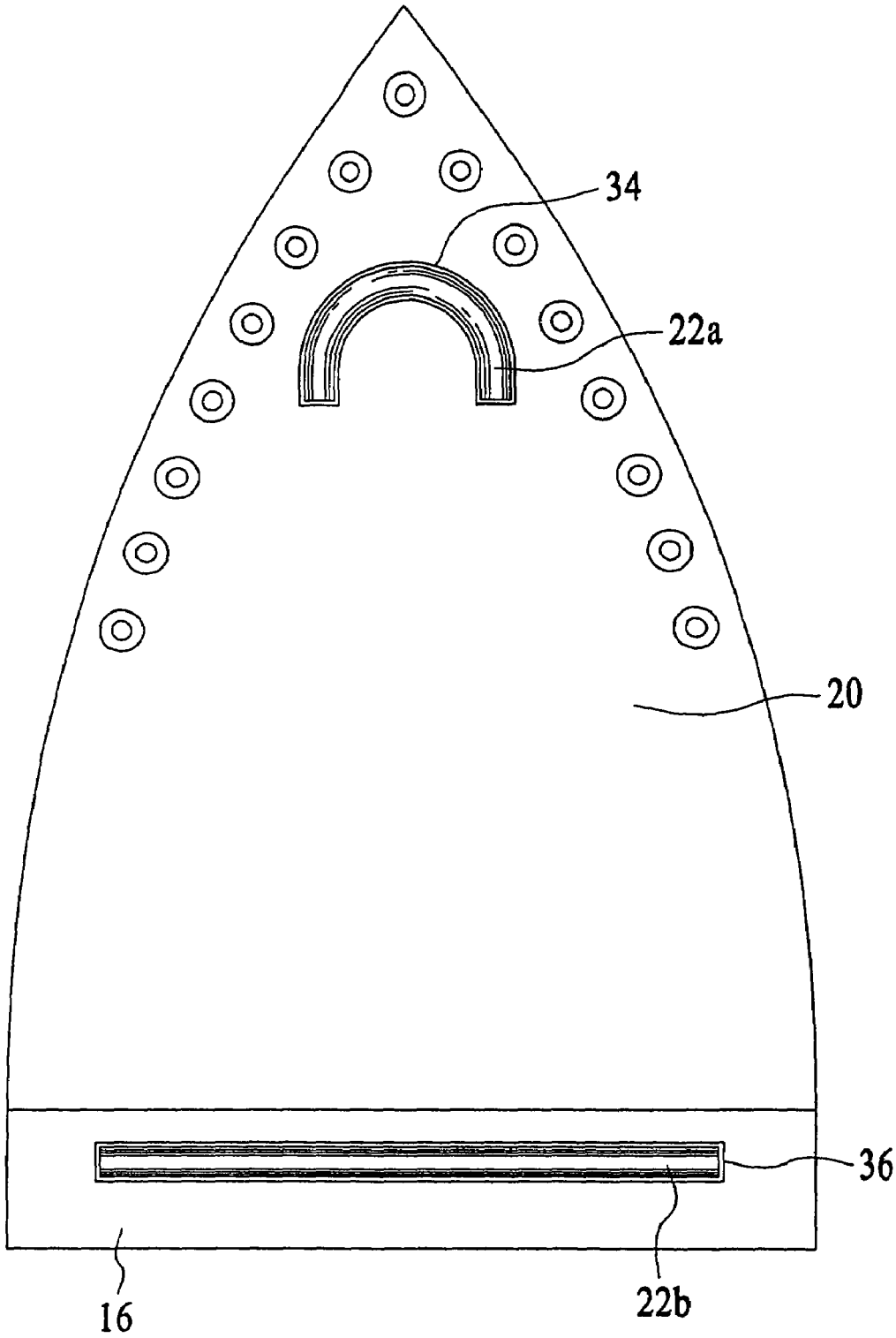
FIG. 4 is a bottom view of the iron embodiment of FIG. 1.

In a preferred embodiment, best seen in FIG. 4, two legs are used, with the front retractable leg 22*a* being crescent shaped and positioned near the pointed tip of the sole plate 20 extending through a similarly shaped aperture 34 in the sole plate 20. The rear retractable leg 22*b* is rectangular and may span the width of the iron 10. The heat barrier 16 has an aperture 36, similar in size and shape of the rear retractable leg 22*b*, to allow the rear retractable leg 22*b* to extend or retract through the heat barrier 16. In alternate embodiments, the retractable rear leg 22*b* may also extend through an aperture in the sole plate 20. In order to prevent the burning of fabric or ironing board surface 26, it is most preferable that the front and rear retractable legs 22*a* and 22*b*, respectively, extend at least one inch beyond the bottom surface of the iron 10. Because of the proximity of the legs 22*a* and 22*b* to the heated sole plate 20 in this embodiment, it is also preferable that the legs 22*a* and 22*b* be formed of heat resistant material. High temperature resistant plastics such as Ultem have been used in prototype construction, however, many other kinds of acceptable commercially available heat resistant materials may be easily identified and used by one skilled in the art, including materials such as ceramics.

Figure 5A:
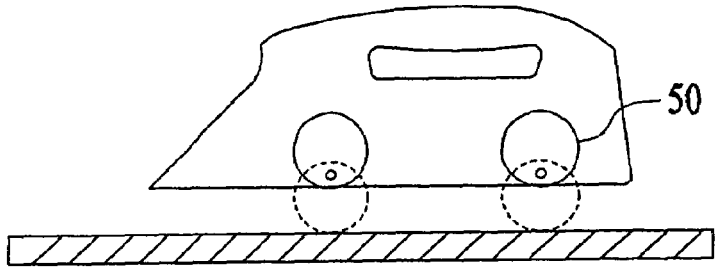
FIG. 5A is a side plan view of an alternate embodiment showing an alternate leg configuration.
Figure 5B:
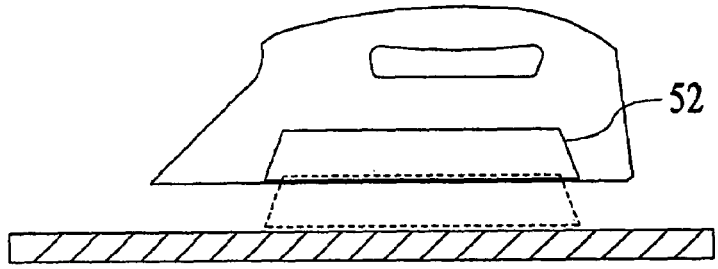
FIG. 5B is a side plan view of an alternate embodiment showing another alternate leg configuration.
Figure 5C:
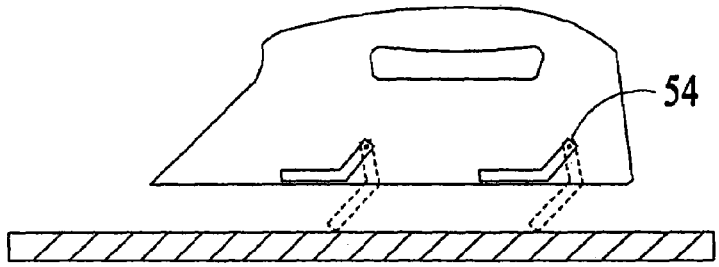
FIG. 5C is a side plan view of an alternate embodiment showing another alternate leg configuration.
Figure 5D:
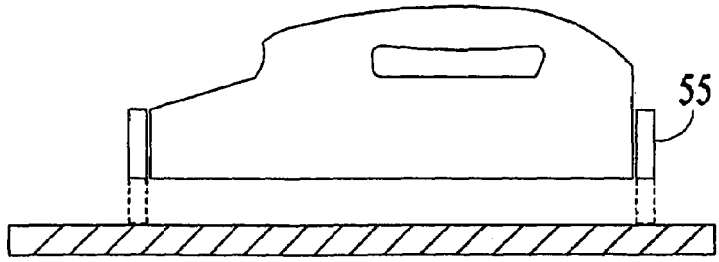
FIG. 5D is a side plan view of an alternate embodiment showing another alternate leg configuration.

In alternate embodiments, the number, shape, and position of the legs 22*a* and 22*b* may be varied as desired. It is a preferred characteristic of the leg configuration selected that the legs provide a stable platform so that the iron 10 is resistant to tipping. Examples of alternate leg configuration embodiments are seen in FIGS. 5A through 5D. FIG. 5A shows an alternate leg configuration embodiment in which the iron 10 is raised and lowered by four off-center wheels 50 attached to the sides of the iron. FIG. 5B shows another alternate leg configuration embodiment in which the iron 10 is raised and lowered by a skirt 52 that moves vertically up and down around the perimeter of the sole plate. FIG. 5C shows another alternate leg configuration embodiment in which the iron 10 is raised and lowered by spider legs 54 attached to the sides of the iron. FIG. 5D shows another alternate leg configuration where legs 55 are moved to the front and the rear section of the iron outside of the iron sole plate. The legs seen in FIGS. 5A through 5D may alternatively extend through apertures in the sole plate 20, or they may extend downward beside the sole plate 20.

Figure 6A:
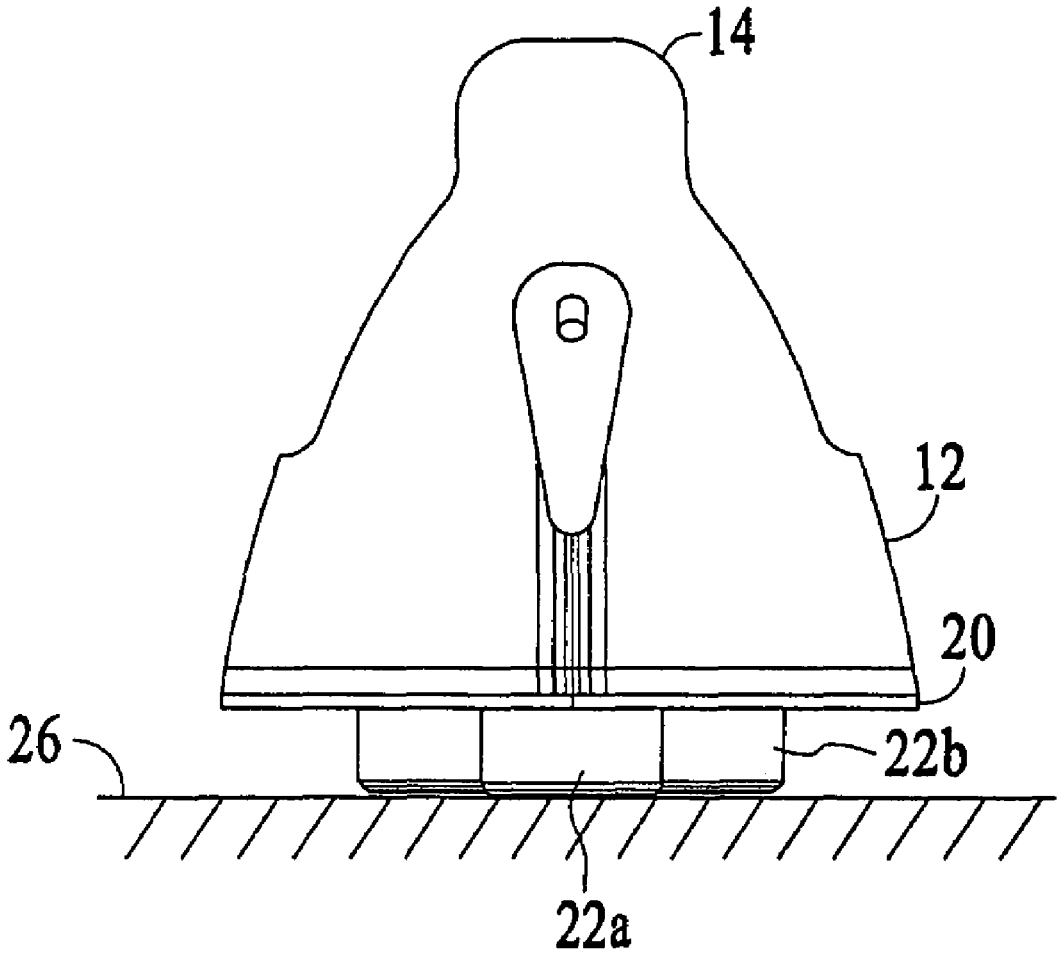
FIG. 6A is a front view of a preferred embodiment of the iron with the elevation mechanism resting on a surface.
Figure 6B:
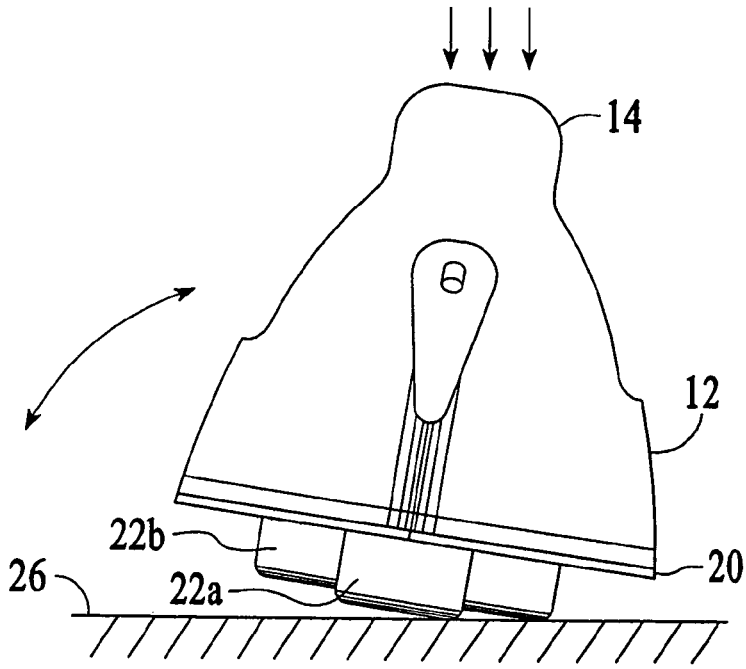
FIG. 6B is a front view of the preferred embodiment of the iron of 6A tilted to one side.
Figure 6C:
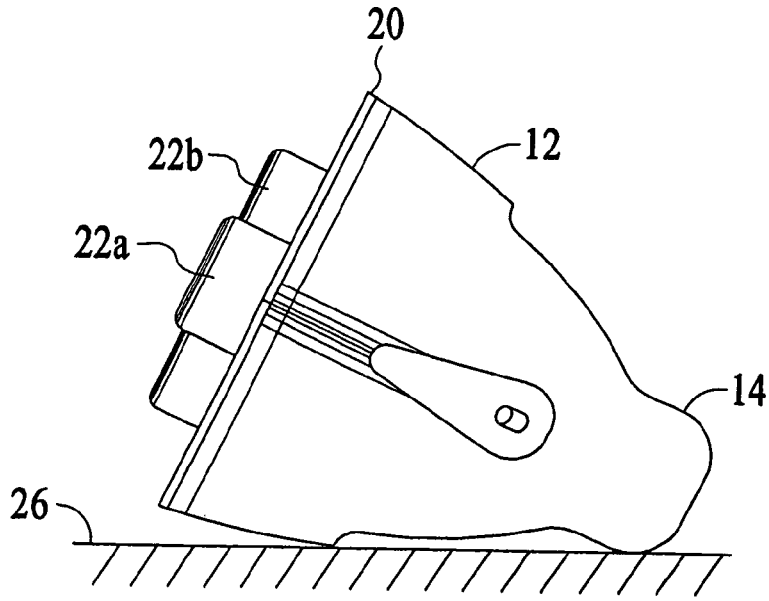
FIG. 6C is a front view of the preferred embodiment of the iron of 6A tilted on its side with the extended legs acting as a sole plate guard to hinder accidental contact with the exposed sole plate.

FIG. 6A shows a preferred embodiment of the iron with the elevation mechanism resting on a surface in a stable position. The extended legs are also designed to function as a sole plate guard in the event the iron is tilted on its side. FIG. 6B shows a preferred embodiment of the iron 10 tilted to sideways. The iron 10 is preferably configured so that the center of gravity is located such that once hand pressure is released from the iron 10 in this position, the iron 10 will move back to its normal resting position. FIG. 6C shows a preferred embodiment of the iron 10 tilted on its side with the housing 12 preventing contact of the sole plate 20 with the support surface. In this position, the extended legs 22*a* and 22*b* act as a guard hindering accidental contact with the sole plate 20.

Returning to FIGS. 3A and 3B, in the preferred embodiment shown, the retractable legs 22*a* and 22*b* are preferably attached to a lift plate so that the legs 22*a* and 22*b* are evenly extended. More specifically, in the preferred embodiment shown in FIGS. 2 and 3, the top surface of the front and rear retractable legs 22*a* and 22*b* are connected to the bottom surface of lift plate 30. The lift plate 30 is preferably spring biased downward. The lift plate 30 is preferably made of heat resistant material and is connected to the retractable legs 22*a* and 22*b*, by any acceptable means, including the use of adhesives, screws, or other known securing means. In prototype construction, the lift plate was made of high temperature resistant plastic, however, many other kinds of commercially available heat resistant materials may be acceptable.

In a preferred embodiment, best seen in FIG. 2, the lift plate 30 is preferably biased downward by springs 42*a* and 42*b*. More specifically, in the preferred embodiment shown in FIG. 2, the spring retaining shafts 41*a* and 41*b* are extended through apertures in the lift plate 30 and retain springs 42*a* and 42*b*. Bushings 45*a* and 45*b* ensure smooth movement of lift plate 30 along shafts 41*a* and 41*b*. Springs 42*a* and 42*b* surround spring retaining shafts 41*a* and 41*b*, respectively, and exert a spring force on lift plate 30, causing lift plate 30 to bias downward. This biased force is preferably sufficient to lift the weight of the iron and to overcome any resistive force of the stepper motor 43 causing the cam 44 to rotate counterclockwise enabling the lift plate 30 to move downwards. In alternate embodiments, the downward bias could be achieved using NITINOL wire, pneumatic components or simple alternate current or direct current motors, synchronous motors, stepper motors, solenoids, mechanical systems, or any combination thereof. These and other means for biasing the lifting plate downward may be easily selected by one skilled in the art in light of this disclosure.

Figure 3:
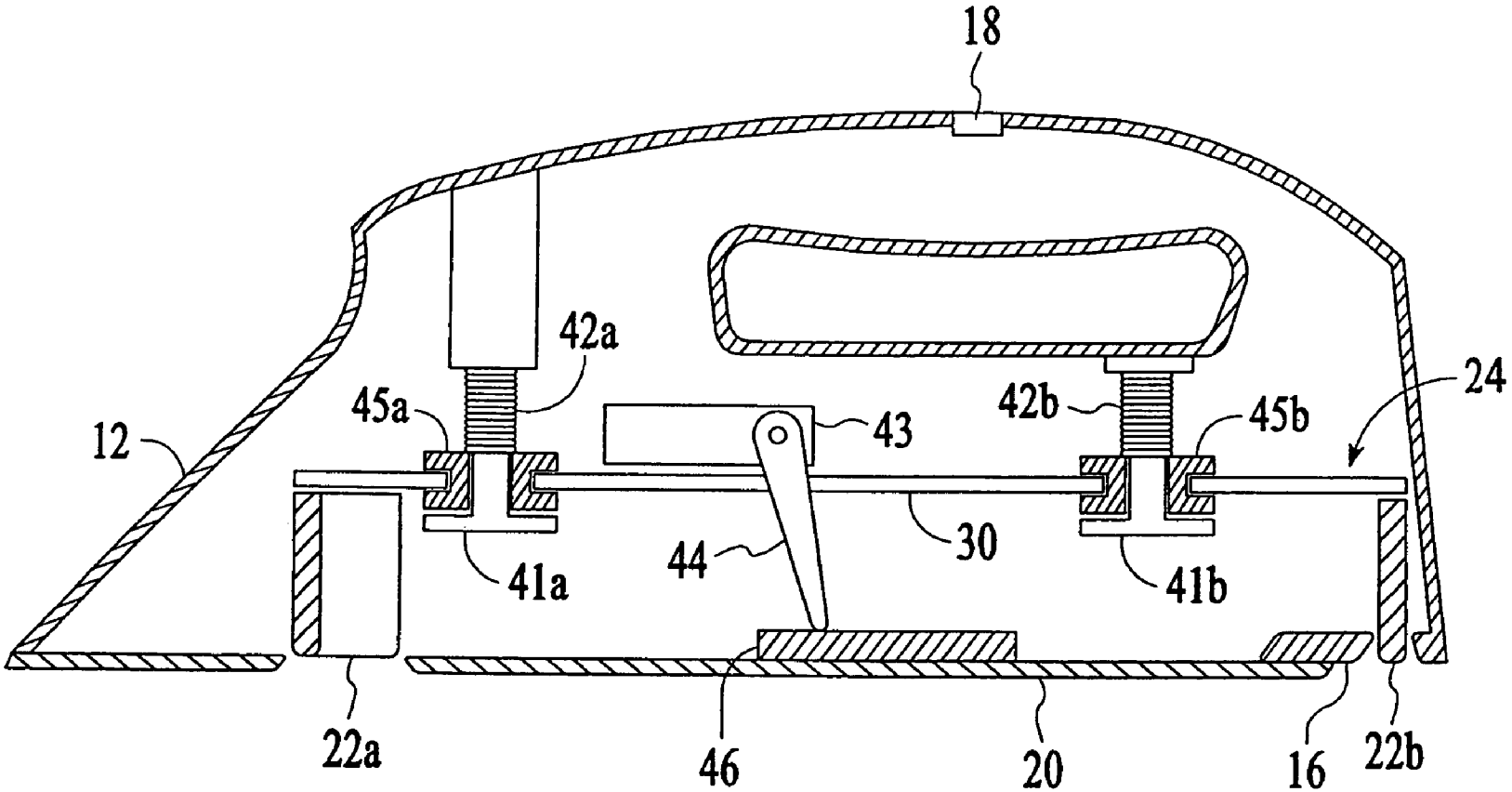
FIG. 3 is a perspective view partly in section showing a preferred embodiment of the elevating mechanism of the invention with the legs withdrawn.

Referring to FIG. 3, the geared stepper motor 43 is used to overcome the downward bias of springs 42*a* and 42*b*. More specifically, in the preferred embodiment, power is supplied to geared stepper motor 43 when actuator device 18 is activated upon detection of the presence of the users hand. When power is supplied to geared stepper motor 43, gear stepper motor 43 rotates cam 44 clockwise against the top of a heat isolation sliding plate 46, pulling lift plate 30 upward against the springs 42*a* and 42*b*. The rotational force of geared stepper motor 43 and cam 44 is sufficient to overcome the bias of springs 41*a* and 41*b*, causing the elevation mechanism 24 to elevate within the body of the iron, thus retracting legs 22*a* and 22*b*. When the iron 10 is deactivated, the geared stepper motor 43 no longer exerts rotational force on the cam 44. Thus, springs 41*a* and 42*b* force elevation mechanism 24 downward, causing legs 22*a* and 22*b* to extend through sole plate 20. The geared stepper motor 43 and 44 cam were used in prototype construction, however, any known mechanical configuration for overcoming spring bias may be used, and such alternatives may be easily selected and constructed by one skilled in the art in light of this disclosure.

The preferred operation of the iron in accordance with the present invention is described below. The electric iron 10 is connected to electric power and turned on. When the iron 10 is not in use the spring biased lift plate 30 is automatically extended downward pushing legs 22*a* and 22*b* through apertures 34 and 36. In this position, the sole plate 20 is elevated away from the cloth or ironing board surface 26. When the sole plate 20 has reached the desired temperature, as determined by a temperature control setting, the user grips the iron 10, and the user's palm contacts the actuator device 18 on the handle 14. The actuator device 18 includes an electric circuit that is normally configured to be normally open and which closes when the user grasps the handle 14, thus completing the electrical circuit, activating the elevation mechanism 24. The elevation mechanism 24 acts to overcome the preferred downward bias of the elevation mechanism 24, raising the lift plate 30 retracting the legs 22*a* and 22*b* into the body of the iron 10. Retraction of the legs 22*a* and 22*b* allows the user to move the hot sole plate 20 of the iron 10 across the fabric or other material to be ironed on the ironing board 26. When the user releases the handle 14, the actuator device 18 opens and breaks the electrical circuit causing the elevation mechanism 24 to deenergize, which allows the downward biased lift plate 30 and legs 22*a* and 22*b* to extend downward raising the hot sole plate 20 above the ironing board surface 26.

Also, in the event of a power outage or other interruption to electric power during use, the iron 10 and the elevation mechanism 24 are deenergized allowing the biased lift plate 30 and legs 22*a* and 22*b* to extend downward.

It is an advantage of the embodiments described herein, that the hot sole plate of the iron is not as exposed to accidental contact by the user when lifted from the working surface, as is the hot sole plate of irons that are placed on the back plate with the hot sole plate extending vertically into the air. Furthermore, the iron of the invention is more stable, and less likely to fall over causing the hot sole plate to make unwanted contact with other materials. As previously explained, the extended legs are also designed to function as a sole plate guard in the event the iron is titled on its side. It is also an advantage of the present embodiments, that the sole plate surface area is maximized and energy efficient. The present invention eliminates the recessed slot in the sole plate required for most hinging tilt mechanism, thus maximizing surface area of the sole plate contacting the surface to be ironed. Hinging tilt mechanisms waste energy because recessed slots are either (a) heated but not used for ironing, or (b) are engineered to remain cool, thus acting as acting as heat sinks. Furthermore, because the iron is intended to be used in a single horizontal plane, the need for a hinged cord is reduced, the steam system maybe easier to build, which may reduce the cost of manufacturing the irons. Also, because the back end or tail of the iron is not reserved for use in standing the iron, designers are free to change the geometry of the back of the iron to add additional functionality or for design purposes. This also eliminates the need for the operator to lift the heavy iron and place the iron on its tail. This feature will help people who suffer from arthritis or other wrist problems. The use in a single horizontal plane will also allow the weight of the iron to be heavier, which is desirable among expert iron users. Because the iron need not stand on its rear, the back end or tail of the iron can include a geometry. For example, it is possible to configure the tail of the iron of the present invention to include a geometry designed to assist the user in ironing over buttons or uneven sections of fabric. Another advantage of the iron of the invention is that it provides a clear visual queue as to the status of the iron. Many prior art irons use colored on/off indicator lamps. However, these indicators are often difficult to see and many users are confused by such indicator designs and are not able to discern the exact state of operation of the iron.

The preferred embodiments described herein are illustrative only, and although the examples given include many specificities, they are intended as illustrative of only a few possible embodiments of the invention. Other embodiments and modifications will, no doubt, occur to those skilled in the art. The examples given should only be interpreted as illustrations of some of the preferred embodiments of the invention, and the full scope of the invention should be determined by the appended claims and their legal equivalents.

What is claimed is:

1. An iron for use on a support surface defining a plane, the iron comprising:

a sole plate, a housing, a sensor capable of sensing the hand of a user, wherein said sensor activates at least one mechanism within said housing, and an elevation mechanism configured to move at least one leg between a first configuration in which said sole plate is disposed away from said support surface and a second configuration in which said sole plate is in contact with said support surface, wherein the at least one mechanism includes an apparatus for releasing steam when said leg is in the second configuration.

2. The iron of claim 1, wherein said at least one leg holds said sole plate in a plane approximately parallel to the plane of the support surface.

3. The iron of claim 1, wherein said at least one leg holds said sole plate at least inch above the support surface.

4. The iron of claim 1, wherein the iron comprises at least two legs.

5. The iron of claim 1, wherein said at least one leg extends through an aperture in said sole plate.

6. The iron of claim 1, wherein said sensor is a sensor selected from the group consisting of: heat sensors, conductivity switches, pressure activated switches, force sensors, capacitive sensors, matched emitter detector pairs, electromechanical switches, mechanical switches, or light or signal emitters and receivers that are interrupted when contacted by the hand of a user.

7. The iron of claim 1, wherein said at least one leg comprises a material with a lower rate of thermal conduction than a rate of thermal conduction of said sole plate.

8. The iron of claim 1, wherein said moving mechanism is selected form the group consisting of a motor, a solenoid, a pneumatic system, shape memory alloy, and steam actuated solenoid.

9. A method of using the iron of claim 1 comprising the method step: activating said sensor by the user, thereby actuating said at least one mechanism within said housing.

10. An iron for use on a support surface defining a plane, the iron comprising: a sole plate, at least one leg for holding said sole plate above a support surface, a sensor-activated elevation mechanism configured to extend said at least one leg away from the iron and retract said at least one leg toward the iron, and an apparatus for releasing steam.

11. The iron of claim 10, wherein said apparatus for releasing steam actuates only when said at least one leg is retracted.

12. An iron for use on a support surface defining a plane, the iron comprising: a sole plate, at least one leg for holding said sole plate above a support surface, and a sensor for activating an elevation mechanism, the elevation mechanism configured to move said at least one leg between a first configuration wherein said sole plate is disposed away from the support surface and a second configuration wherein said sole plate is in contact with the support surface, and wherein a rate of thermal conduction of said at least one leg is different than a rate of thermal conduction of said sole plate.

13. The iron of claim 12, wherein said rate of thermal conduction of said at least one leg is lower than said rate of thermal conduction of said sole plate.

* * * * *